United States Patent [19]

Robson

[11] Patent Number: 4,991,636

[45] **Date of Patent: * Feb. 12, 1991**

[54] TIMBER PLANING MACHINES

[75] Inventor: Thomas Robson, Houghton-le-Spring, United Kingdom

[73] Assignee: Wadkin PLC, Leicester, England

[ * ] Notice: The portion of the term of this patent subsequent to Aug. 12, 2005 has been disclaimed.

[21] Appl. No.: 12,931

[22] PCT Filed: Jul. 22, 1986

[86] PCT No.: PCT/GB86/00435

§ 371 Date: Feb. 5, 1987

§ 102(e) Date: Feb. 5, 1987

[87] PCT Pub. No.: WO87/01067

PCT Pub. Date: Feb. 26, 1987

[30] Foreign Application Priority Data

Aug. 16, 1985 [GB] United Kingdom ..... 8520563

[51] Int. Cl.[5] ..... B27C 1/00

[52] U.S. Cl. ..... 144/116; 144/117 R; 144/117 B; 144/128; 144/252 R; 144/242 C; 144/246 E; 144/249 R

[58] Field of Search ..... 144/114, 116, 117 R, 144/117 B, 128, 252 R, 252 P, 242 A, 242 C, 245 A

[56] References Cited

U.S. PATENT DOCUMENTS

| | | | |
|---|---|---|---|
| 2,552,367 | 5/1951 | Carlson | 144/128 |
| 4,196,760 | 4/1980 | McDaniel et al. | 144/128 |

FOREIGN PATENT DOCUMENTS

| | | | |
|---|---|---|---|
| 570916 | 1/1924 | France | 144/116 |
| 2547762 | 12/1984 | France | 144/117 |
| 1020571 | 2/1966 | United Kingdom | 144/116 |

*Primary Examiner*—W. Donald Bray
*Attorney, Agent, or Firm*—Kalish & Gilster

[57] ABSTRACT

A machine for planing lengths of timber comprises mutually perpendicular spindles for cutter blocks (7,8). The spindle carrying the cutter block (8) extends below a machine bed (1). The spindle carrying the cutter block (7) extends across the bed (1). A conveyor (5) is provided for feeding a workpiece past the cutter blocks (7,8) at a lower level than the bed. In a modification the spindle carrying the cutter block (7) drives a cutter block (9) which is offset from the spindle itself.

14 Claims, 8 Drawing Sheets

TIMBER PLANING MACHINES

DESCRIPTION

Technical Field

The invention relates to machines for planing and straightening lengths of timber. In such a machine, rough square-sawn timber is surface planed and cut to a predetermined thickness at an early stage in its use in manufacture. Such machines can similarly be used on a limited range of plastics and composite materials.

Background Art

Timber planing machines comprise a bed and a fence providing a datum line along which a piece of timber is passed for planing. Several cutters are generally provided for removing a large amount of wood from a single face of a piece of timber which is bowed or twisted, and/or for planing mutually perpendicular faces. The need to force a workpiece into contact with a cutter makes it very difficult in practice to plane mutually parallel faces of a workpiece on a single pass through the machine. At least three passes are generally required for a workpiece to be planed all round on a conventional single purpose planing machine, and this makes it necessary for the workpiece to be carried back to the input end of the machine after the second pass.

U.S. Pat. Nos. 4,316,491 (Kearnes) and 4,441,536 (Rautio) describe machines for processing round logs of timber. The logs are rough-squared, that is to say they are provided with mutually perpendicular datum faces. The machines are not suitable for planing square-sawn timber, and do not straighten a workpiece.

THE INVENTION

A machine according to the invention comprises mutually perpendicular spindles for cutter blocks, a first one of the spindles extending below a machine bed, a second extending across the bed beyond the first, means for feeding a workpiece past the cutter blocks at a lower level than the bed and said mechanism for conveying the workpiece beyond the first spindle.

In operation, on a first pass through the machine, the workpiece is planed on two mutually perpendicular faces by parts of cutter blocks adjacent to and extending over the bed. On a second pass back through the machine at the lower level, the other two faces are planed by parts of the cutter blocks below the bed and extending to the side of the first cutter block remote from the first pass. Two operators, one at each end of the machine, can maintain a high level of activity passing workpieces through the machine once in each direction for planing on all four faces. The sense of rotation of the cutters, if correct for the first pass, is automatically correct for the second.

The means for feeding the workpiece past the cutter blocks at the lower level is preferably a conveyor belt. This is suitable for maintaining the necessary pressure to keep the workpiece in contact with the second cutter block which extends across the bed. The conveyor belt makes it possible to use idler rollers to maintain the pressure to feed the workpiece, and consequently to do without driven rollers in this part of the machine. Alternatively, driven rollers could be used to feed the workpiece over a thicknessing table at the lower level.

The machine may be provided with spindles for more than one cutter block to plane any face of a workpiece. A moulding attachment may be provided at either end of the machine, and is preferably adjustable in all directions in order to mould the workpiece as required. The proximity of the essential two cutter blocks to each other facilitates the extraction from the machine of the chips produced in operation.

When planing a piece of timber which is badly bowed or twisted, or of great width, it is advantageous first to plane a lower face to provide a flat datum surface, and then to plane a face perpendicular thereto. Thus, in a modification, the spindles do not themselves actually each carry two cutter blocks; that is one above and one below the machine bed and one to each side of the other spindle. Either or both of the mutually perpendicular spindles drives a cutter block which is offset from the spindle itself. Any combination of such arrangements on either or both of the spindles may be provided according to customer requirements.

DRAWINGS

Figure 4:
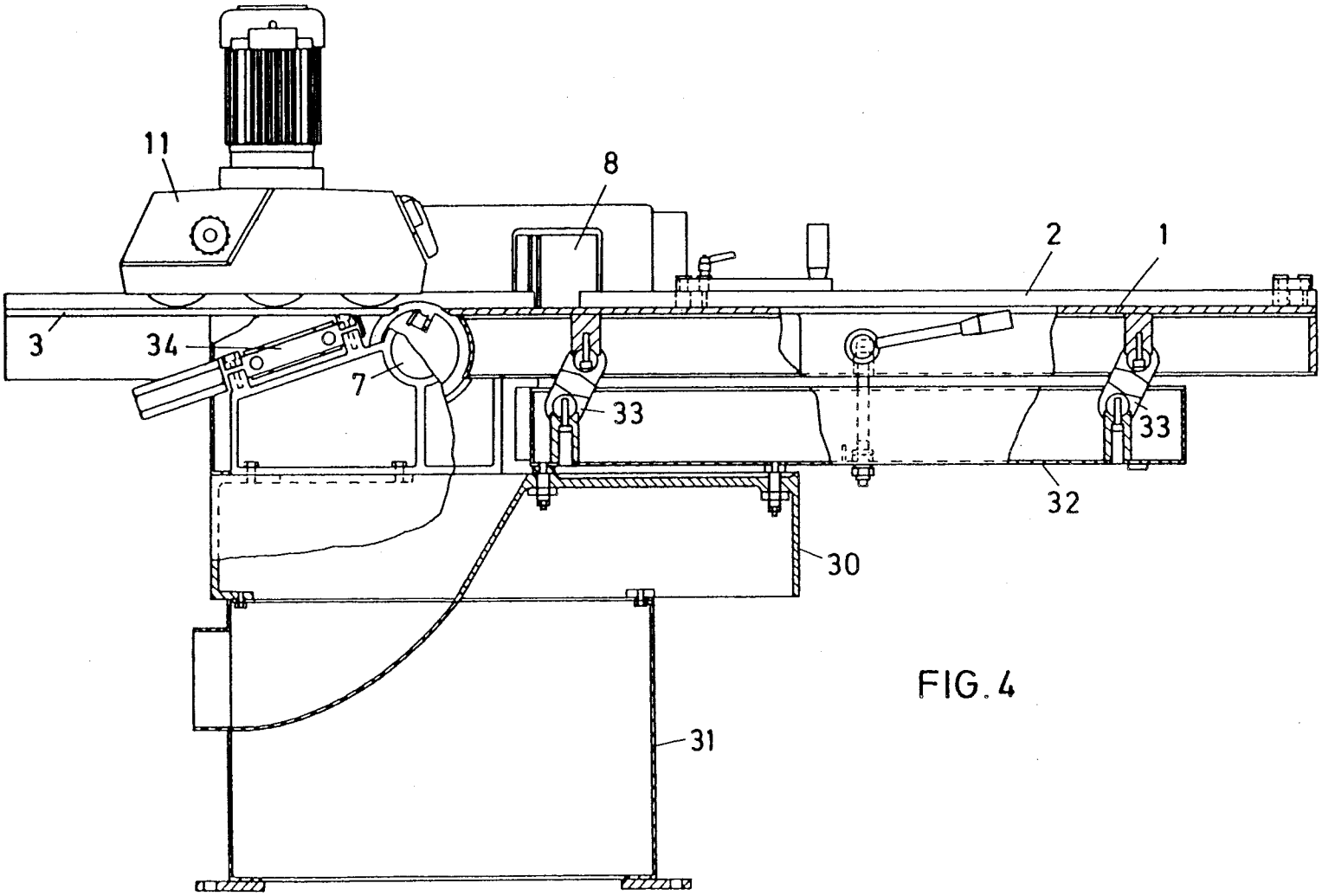
FIG. 4 is a vertical section through the planing side of the machine of the preceding Figures, that is the side of the machine at which the first two sides of the workpiece are planed.
Figure 4A:
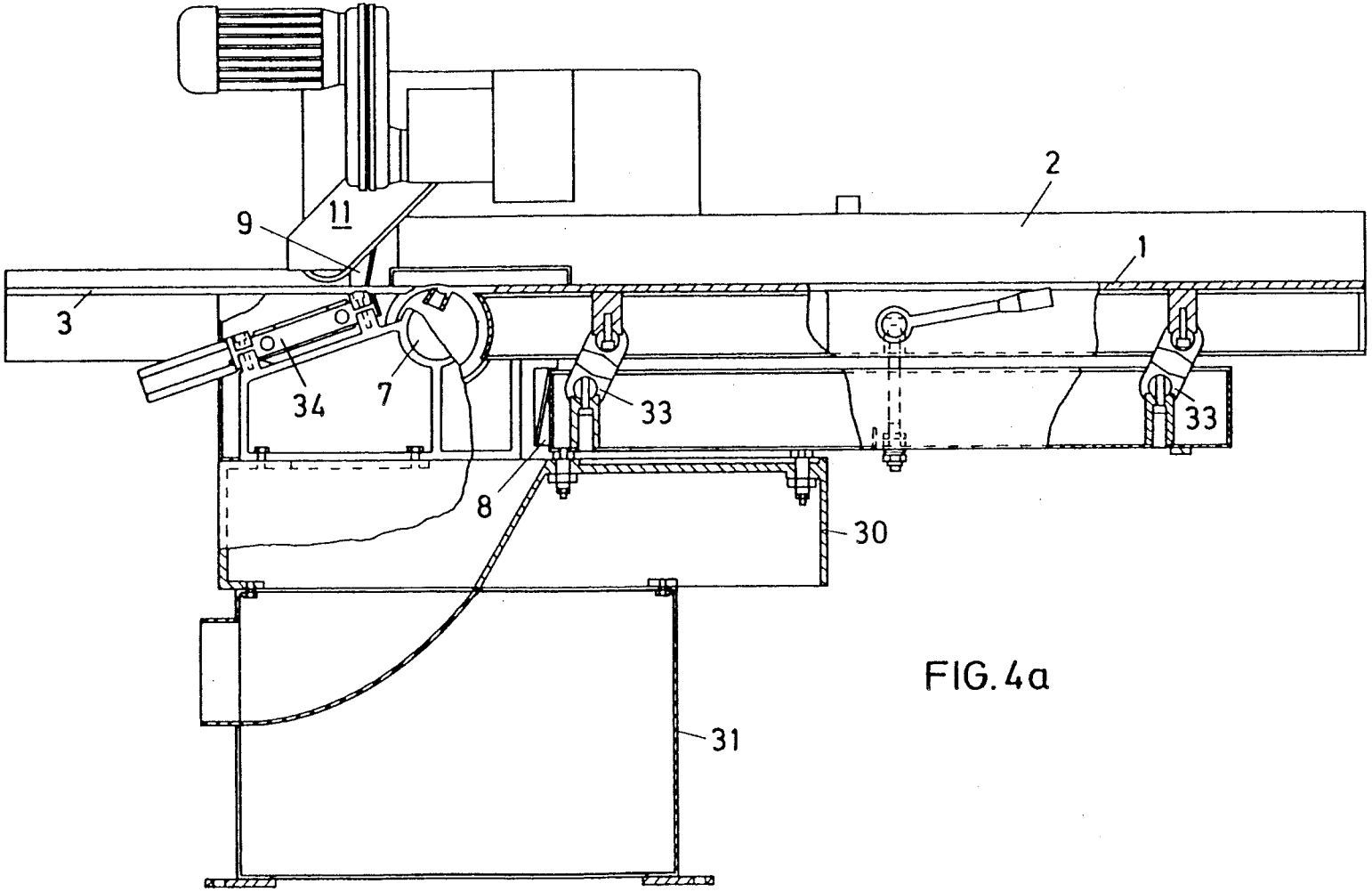
Figure 5:
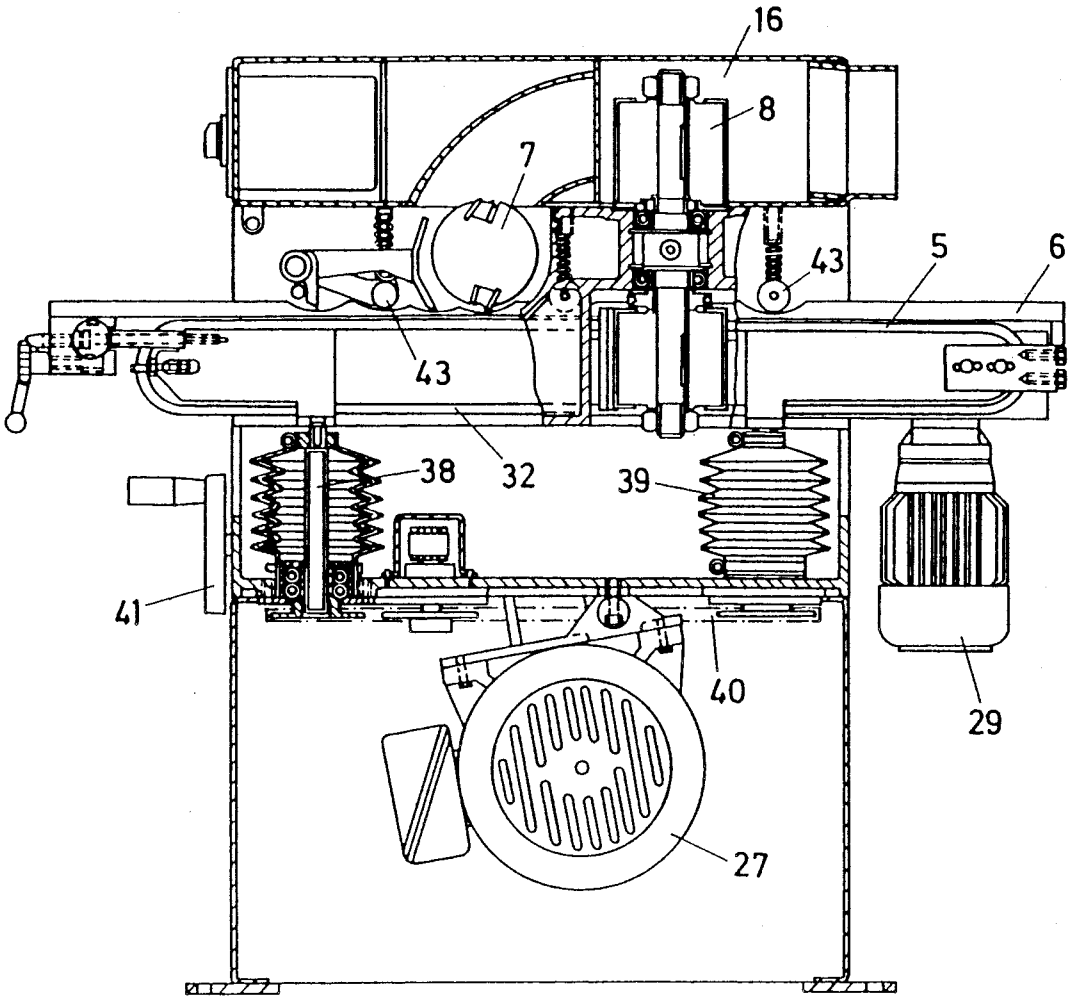
FIG. 5 is a section of the thicknessing or other side of the machine of the preceding Figures.
Figure 5A:
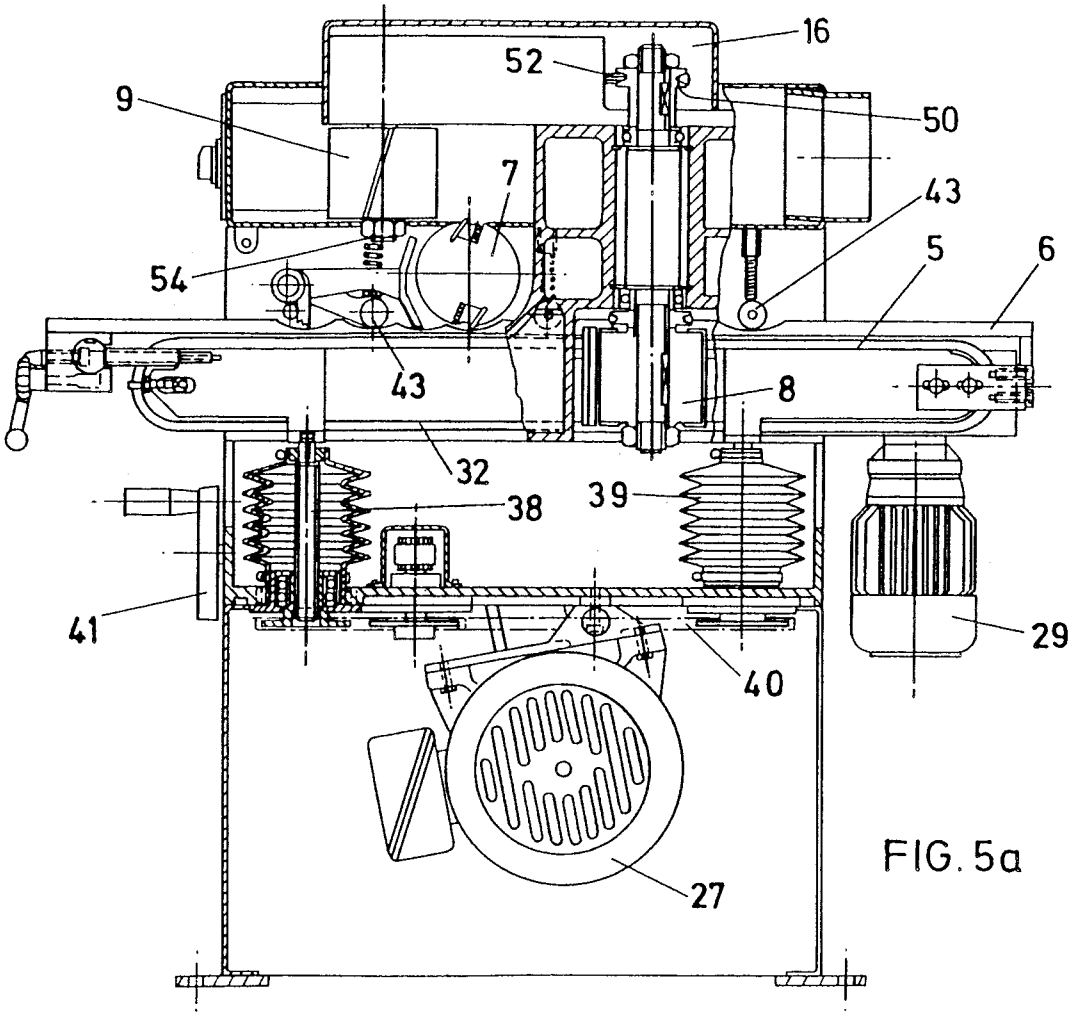
Figure 6:
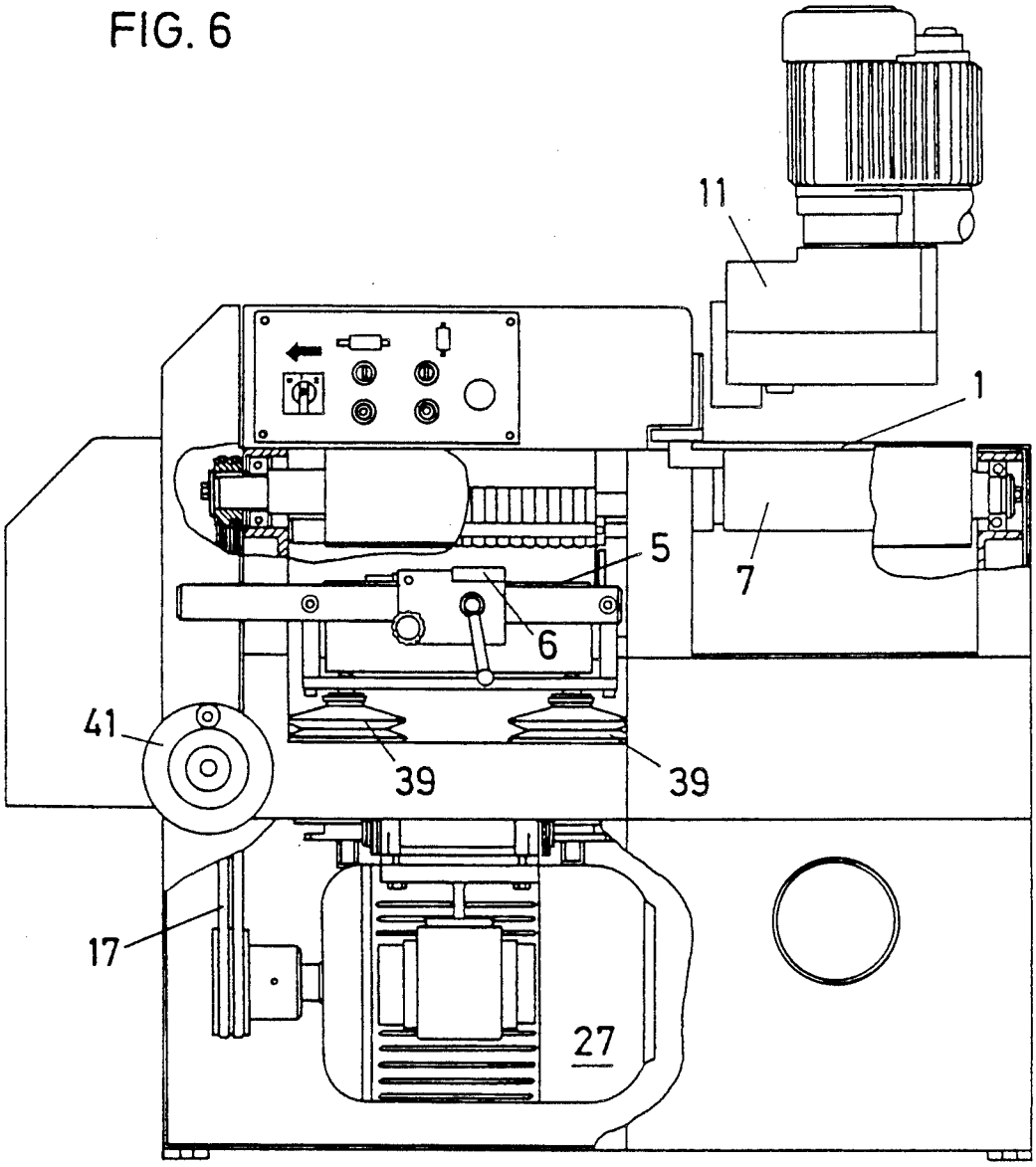
FIG. 6 is a sectional end view of the same machine.

FIG. 4*a* is a vertical section corresponding to FIG. 4 through the planing side of a modified machine according to the invention, that is through the side of the machine at which the first two sides of the workpiece are planed; and FIG. 5*a* is a section of the thicknessing or other side of the machine of FIG. 4*a*.

BEST MODE

Figure 1:
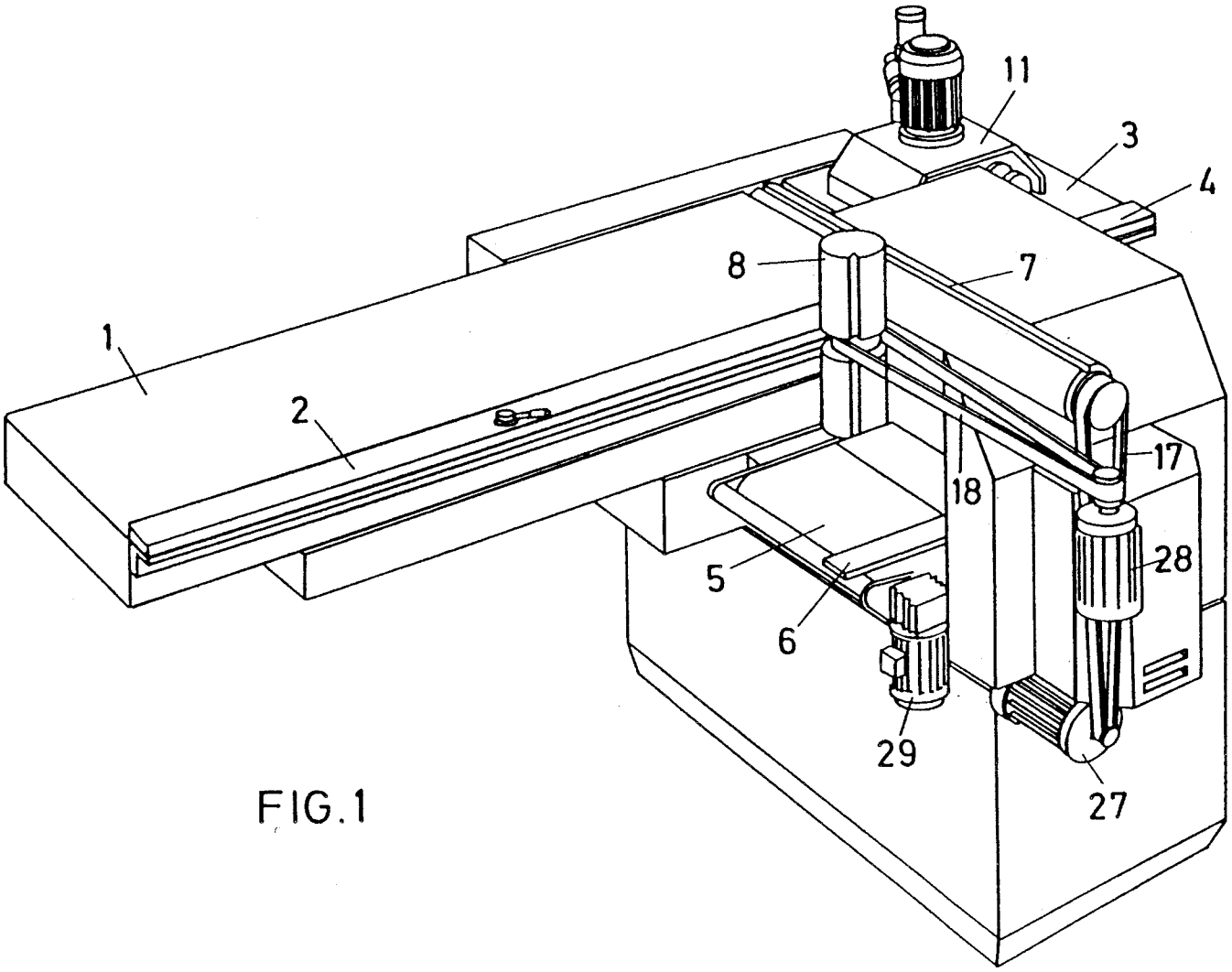
FIG. 1 is an overall view of a machine according to the invention.

With particular reference to FIG. 1, the machine comprises a bed or infeed table 1, and a fence 2 along which a workpiece is passed for planing. The workpiece passes to an outfeed table 3 and an outfeed fence 4. The workpiece is then placed on a lower or thicknessing table 5 against a fence 6 where it is passed back through the machine and planed on the remaining two sides. A main cutter block 7 extends across the infeed table 1 and over the thicknessing table 5. A side cutter block 8, perpendicular to the main cutter block 7 and adjacent the infeed table 1, extends below the table 1 for planing the side of the workpiece in the thicknessing or second pass through the machine.

The workpiece is generally introduced onto the table 1 by an operator to the left of FIG. 1, and conveyed through the machine on a first pass by a feed mechanism 11 beyond the main cutter block 7. The workpiece planed on the first two sides is then removed from the outfeed table 3, generally by a second operator standing to the right of FIG. 1. The second operator then places the workpiece on the thicknessing table 5, which comprises a conveyor belt on which the workpiece is held in contact by the pressure of idler rollers 43 (FIG. 5). The workpiece is conveyed along the fence 6 to the left in FIG. 1 as it is thicknessed or planed on the remaining two sides by the parts of the cutter block 7 extending across the table 1 beyond the side cutter block 8, and of the block 8 extending below the table 1. The cutter blocks 7, 8 are driven respectively through belts 17, 18 from electric motors 27, 28. The thicknessing table conveyor 5 is driven by an electric motor 29.

Figure 2:
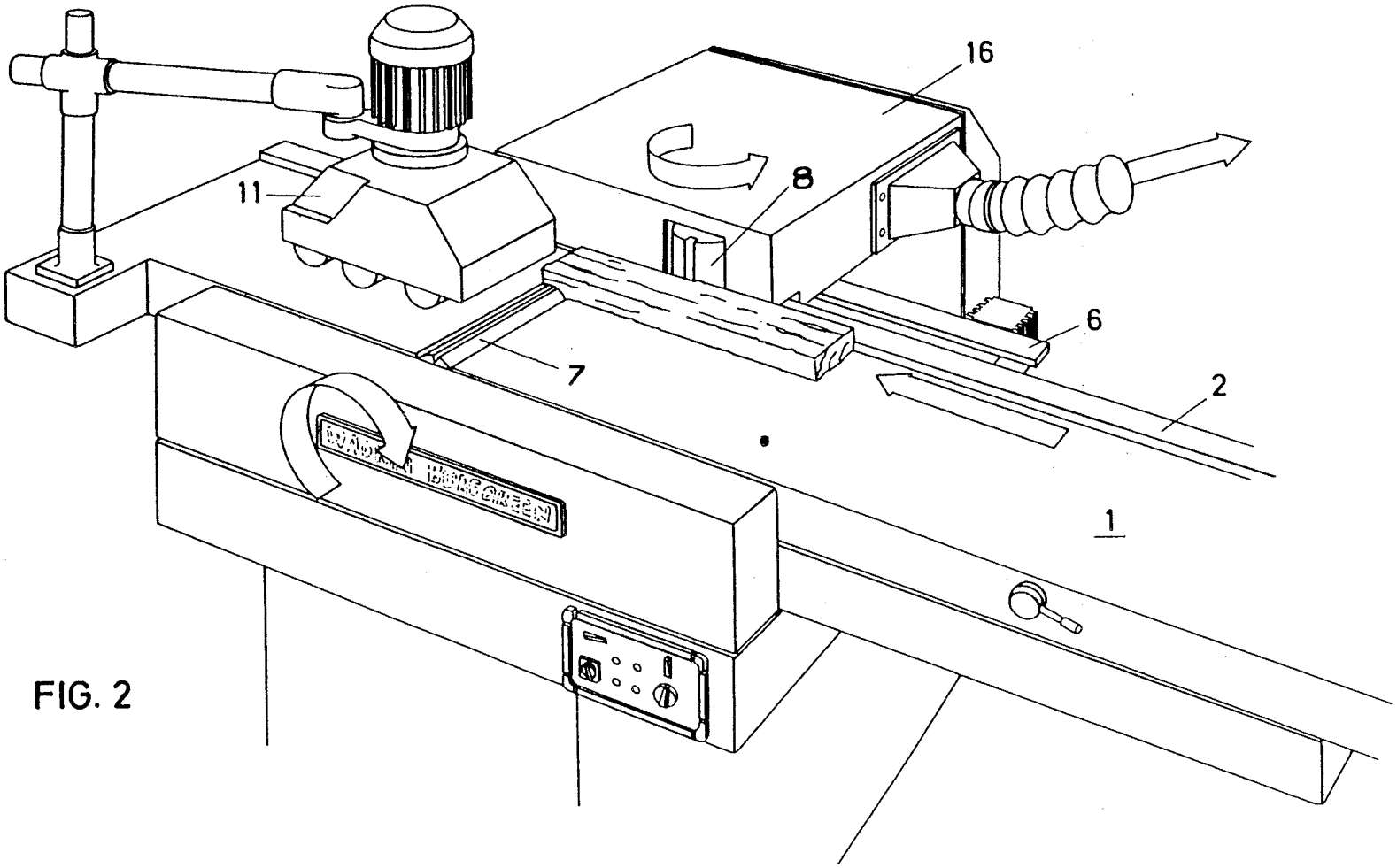
FIG. 2 is a view similar to FIG. 1 from the other side of the machine showing the planing of the first two sides of a workpiece.
Figure 3:
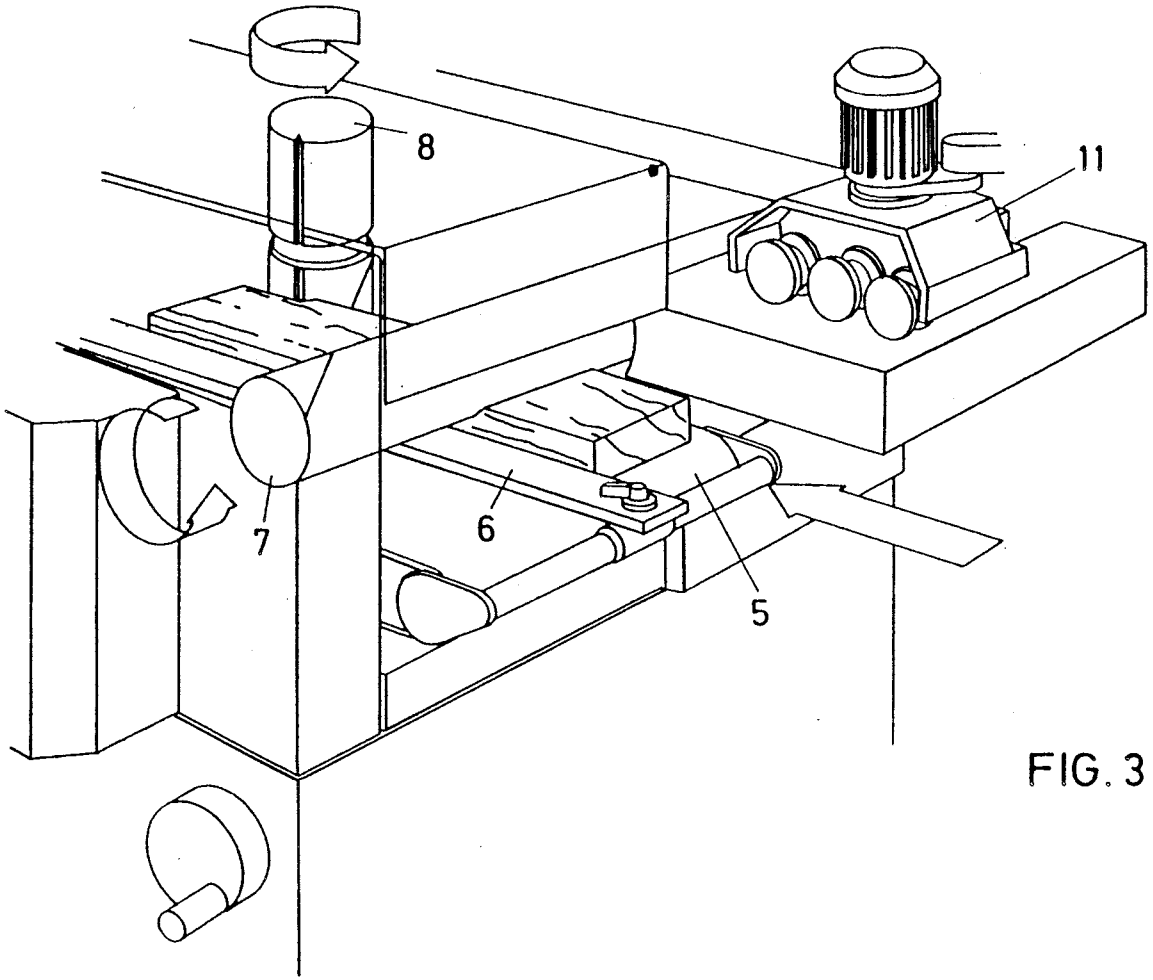
FIG. 3 is a closer view of the machine of FIGS. 1 and 2 from yet another stand-point showing the thicknessing or planing of the remaining two sides of the workpiece.

In FIG. 2, there appears a piece of timber or workpiece being planed on its first two sides on its first pass through the machine. It can be seen how an extractor 16 for chippings produced in the planing on both the first and second passes through each machine is conveniently arranged over the cutter blocks 7, 8. In FIG. 3, the workpiece is shown on its second pass through the machine on which the remaining two sides are planed. The whole workpiece is thereby dimensioned.

Turning now to the sectional views, and FIG. 4 first of all, it can be seen that the machine comprises a structurally rigid plinth 30 mounted on a box base 31. The infeed table 1 is mounted on a frame member 32 by swing links 33 for varying the depth of cut taken by the main cutter block 7. The fence 2 is adjustable on swing links to vary the depth of cut taken by the side cutter block 8. The outfeed table 3 is equipped with a fine adjustment handle 34 for levelling the table to the main cutter block 7, for example on re-setting after changing cutter knives.

The second sectional view from the thicknessing side in FIG. 5 shows how the frame member 32 is supported on the plinth 30 by four screws 38, one at each corner, and only two of which appear in FIG. 5, one in section and the other covered by a protective bellows 39.

The screws 38 are linked by a chain 40 so that the frame 32 can be raised or lowered at one time by adjustment of the screw 38 through the chain 40 and a handle 41 to give the required finished thickness of the timber. The fence 6 is adjusted along a fence bar to give the required finished width.

Turning now to the modification of FIG. 4*a*, there is no planer side cutter block 8 above the table 1 to the right of the centre of the machine. The thicknesser side cutter block 8 can however still be seen below the table 1. More detail is visible in FIG. 5*a*, where it can be seen that the spindle on which the cutter block 8 is mounted extends upward by the side of the extractor 16 and has a pulley wheel 50 keyed thereon. The pulley wheel 50 drives a belt 52 to rotate a further spindle 54 which carries a planar side cutter block 9. It will be noted that the planer side cutter block 9 is to the outfeed side of the main cutter block 7, while in the former embodiment of FIG. 4 the planer side cutter block 8 was to the infeed side of the main cutter block 7. Thus according to the present modification a lower face of a workpiece is planed first to provide a flat datum surface.

Other differences between the present modified construction as best shown in FIG. 4*a*, and the former embodiment of FIG. 4, although of no particular relevance to the invention, are that the infeed fence 2 is much deeper, and the feed mechanism 11 is quite different.

Although not illustrated in the drawings, it will be understood that the spindle driving the main cutter block 7, may similarly drive a subsidiary spindle parallel to but offset from itself, and the subsidiary spindle may carry a cutter block for planing a part of a surface different from that planed by the block 7. Either one or both of the spindles carrying the cutter blocks 7, 8 may be provided with a subsidiary offset spindle.

I claim:

1. A machine for planing and straightening lengths of timber comprising a bed, first and second mutually perpendicular spindles for cutter blocks adjacent the bed, feed mechanism beyond said first spindle with respect to the passage of a workpiece along the bed for conveying the workpiece, an extractor for chips, said first spindle extending below the bed said second spindle extending across the bed beyond the first spindle, and means for feeding the workpiece past the cutter blocks downwardly of said bed.

2. A machine according to claim 1 in which the means for feeding is a conveyor belt.

3. A machine according to claim 2 in which there is an idler roller for maintaining the pressure to feed the workpiece.

4. A machine according to claim 3 in which either of said mutually perpendicular spindles drives a cutter block which is offset from the spindle itself.

5. A machine according to claim 3 in which both of the mutually perpendicular spindles drives a cutter block which is offset from the spindle itself.

6. A machine for planing and straightening lengths of timber comprising an infeed bed, a fence extending longitudinally on said infeed bed and along one side thereof, there being an outfeed bed planarwise aligned with said infeed bed and in longitudinal alignment therewith, an outfeed fence provided along one side portion of said outfeed bed in alignment with the fence along the infeed bed, a main cutter block provided in axial transverse relationship to said out feed and infeed beds and being disposed therebetween, a side cutter block perpendicular to the main cutter block being provided adjacent the infeed table, said side cutter block extending below said infeed table, a thicknessing table provided in planarwise disposition to said infeed and outfeed tables but being disposed downwardly and laterally outwardly beneath same, being longitudinally parallel therewith, there being a fence provided along one side margin of said thicknessing table, said main cutter block presented upwardly and transversly of said thicknessing table, said side cutter block progressing downwardly adjacent said thicknessing table in lateral disposition with respect thereto, first motor means for driving said main cutter block, and second motor means for driving said side cutter block.

7. A machine for planing and straightening lengths of timber as defined in claim 6 and further characterized by said main cutter block and side cutter block being in mutually perpendicular relationship, said cutter blocks being disposed for acting upon workpieces moving along said infeed table and said thicknessing table.

8. A machine for planing and straightening lengths of timber according to claim 7 and further characterized by a structurally rigid plinth provided on the machine, a box base mounting said plinth, there being means engaging said infeed table for adjusting the disposition thereof for varying the depth of cut taken by the main cutter block.

9. A machine of planing and straightening lengths of timber according to claim 8 thereby means are provided for adjusting the disposition of the side cutter block for varying the depth of cut taken thereby.

10. A machine for planing and straightening lengths of timber as defined in claim 6 wherein conveyor means are provided on said thicknessing table for moving a workpiece therealong.

11. A machine for planing and straightening lengths of timber as defined in claim 6 and further characterized by a chip extractor being provided in covering relationship to said cutter blocks.

12. A machine for planing and straightening lengths of timber as defined in claim 11 wherein means are provided for adjusting the height of the infeed table fence for varying the depth of cut taken by the side cutter block.

13. A machine for planing and straightening lengths of timber as defined in claim 6 wherein the side cutter block is located on the infeed table side of said main cutter block.

14. A machine for planing and straightening lengths of timber according to claim 13 wherein a planer side cutter block is provided on the outfeed table side of said main cutter block, and drive means interconnecting said side cutter block and said planer side cutter block for effecting rotation of the latter.

* * * * *